US007101323B1

(12) United States Patent
Steffee et al.

(10) Patent No.: US 7,101,323 B1
(45) Date of Patent: Sep. 5, 2006

(54) TRACKING PULLEY ECCENTRIC HUB INSERT FOR EXERCISE APPARATUS

(75) Inventors: Clay J. Steffee, Alexandria, KY (US); Dennis Whaley, Templeton, CA (US)

(73) Assignee: Brunswick Corporation, Lake Forest, IL (US)

( * ) Notice: Subject to any disclaimer, the term of this patent is extended or adjusted under 35 U.S.C. 154(b) by 400 days.

(21) Appl. No.: 10/403,975

(22) Filed: Mar. 31, 2003

(51) Int. Cl.
*A63B 21/00* (2006.01)

(52) U.S. Cl. ..... 482/100; 482/137; 482/97

(58) Field of Classification Search ..... 482/100, 482/137, 97, 101, 126–129, 139; 254/411, 254/415

See application file for complete search history.

(56) References Cited

U.S. PATENT DOCUMENTS 4,515,363 A * 5/1985 Schleffendorf ..... 482/100
5,580,341 A * 12/1996 Simonson ..... 482/100

* cited by examiner

*Primary Examiner*—Jerome Donnelly
(74) *Attorney, Agent, or Firm*—Andrus, Sceales, Starke & Sawall, LLP

(57) ABSTRACT

Exercise apparatus has a belt tracking pulley having a hub insert with an eccentric bore therethrough for changing tracking angle. The tracking pulley mounting structure has adjustable eccentricity.

8 Claims, 6 Drawing Sheets

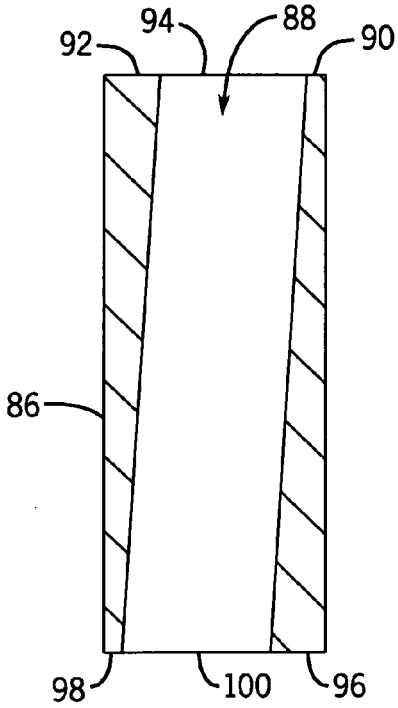
FIG. 8
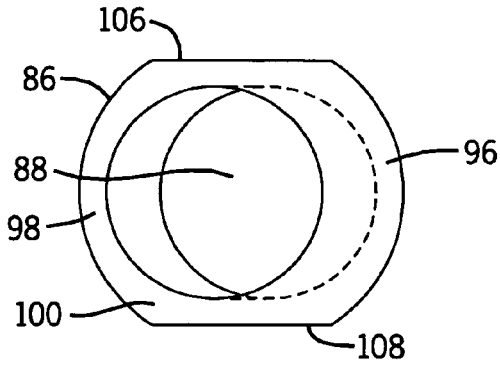
FIG. 9
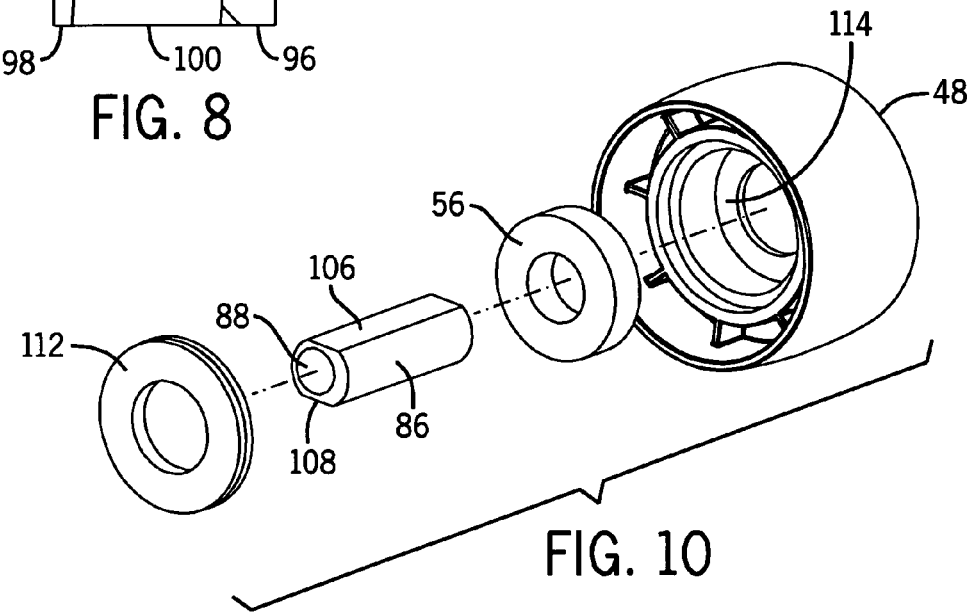
FIG. 10
FIG. 11
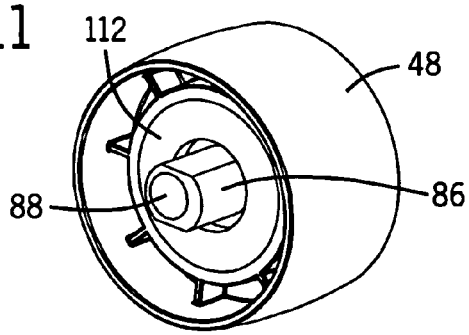

TRACKING PULLEY ECCENTRIC HUB INSERT FOR EXERCISE APPARATUS

BACKGROUND AND SUMMARY

The invention relates to exercise apparatus, and more particularly to a tracking pulley and mounting therefor.

Exercise devices are known which employ a belt trained around a pulley system and connected to a source of resistance such as a weight stack. The present invention relates to improvements in a tracking pulley between guide pulleys, and enables simple and effective tracking adjustment.

BRIEF DESCRIPTION OF THE DRAWINGS

FIG. 8 is a sectional view of an alternate embodiment of an eccentric hub insert in accordance with the invention.

FIG. 9 is an end elevation view of the structure of FIG. 8.

FIG. 10 is an exploded isometric view of a tracking pulley incorporating the hub insert of FIG. 8.

FIG. 11 is an isometric assembled view of the structure of FIG. 10.

DETAILED DESCRIPTION

Figure 1:
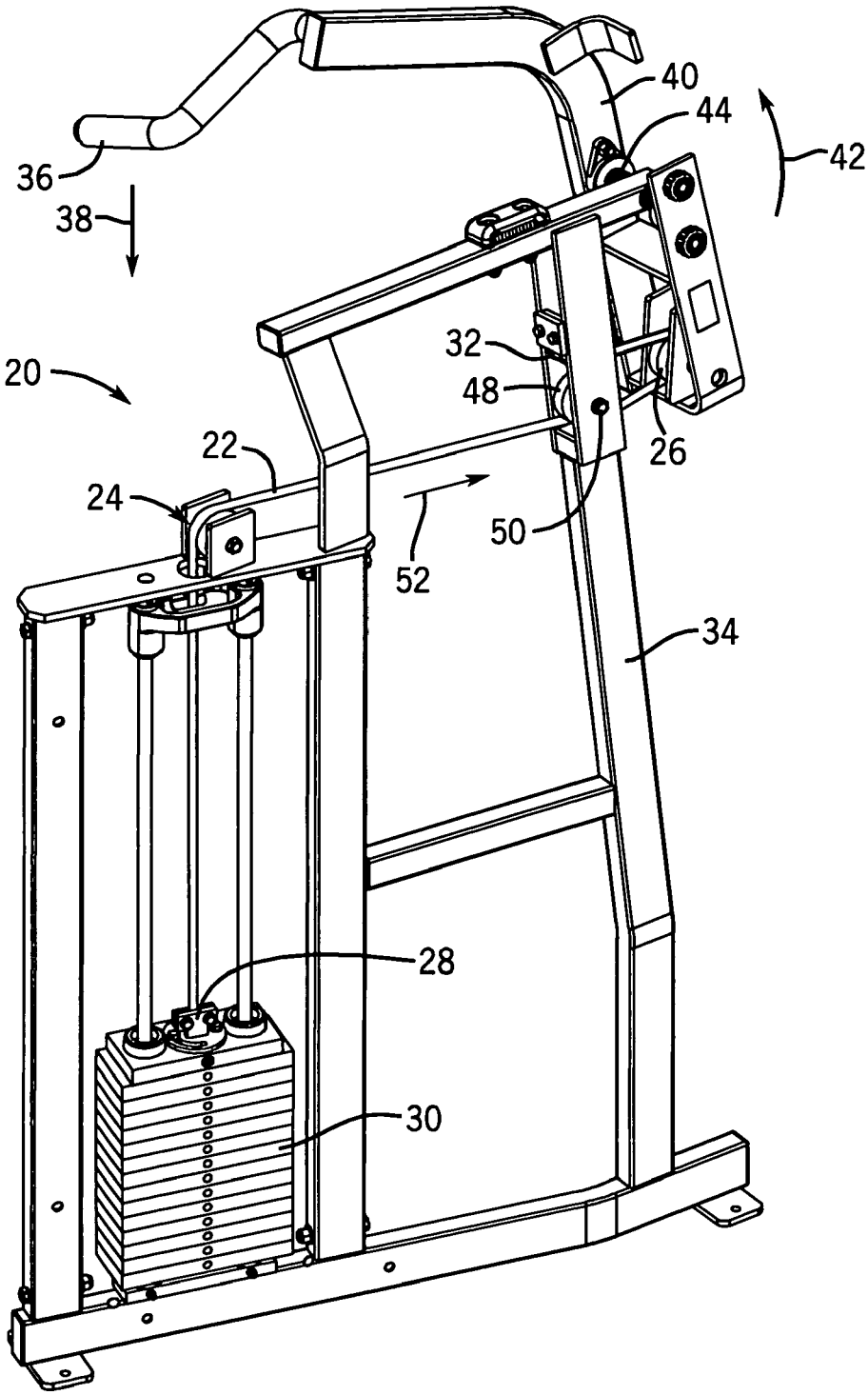
FIG. 1 is a partially schematic isometric view of exercise apparatus in accordance with the invention.
Figure 2:
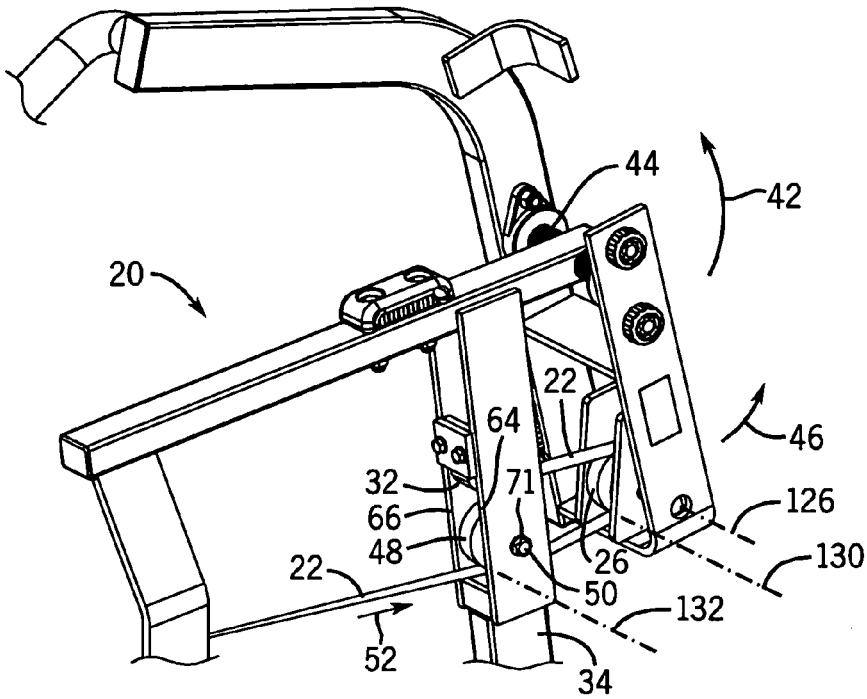
FIG. 2 is an enlarged view of a portion of FIG. 1.
Figure 3:
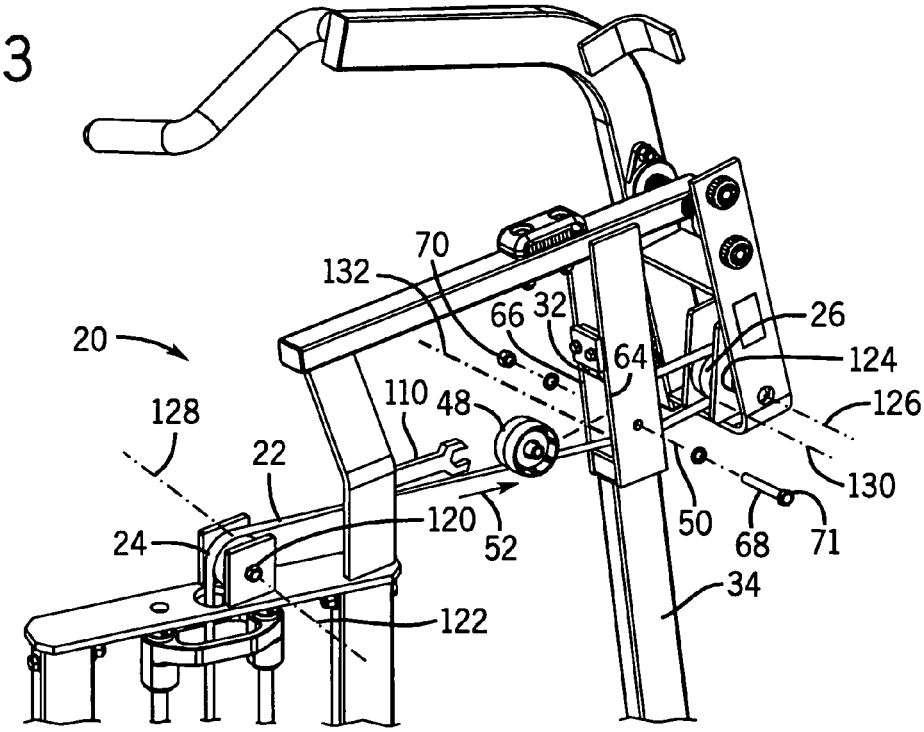
FIG. 3 is like FIG. 2 and shows an exploded partially assembled view.

FIGS. 1–3 show exercise apparatus 20 including a belt 22 trained around various guide pulleys such as 24 and 26, and having one end 28 connected to a source of resistance such as weight stack 30, and having another end 32 fixed to frame 34. Upon downward movement of handles such as 36 as shown at arrow 38, arm 40 pivots counterclockwise as shown at arrow 42 about pivot 44 to move pulley 26, FIG. 2, rightwardly and counterclockwise as shown at arrow 46, which movement is resisted by weight stack 30, all as is known. Pulleys 24 and 26 guide and train belt 22 therearound.

Figure 4:
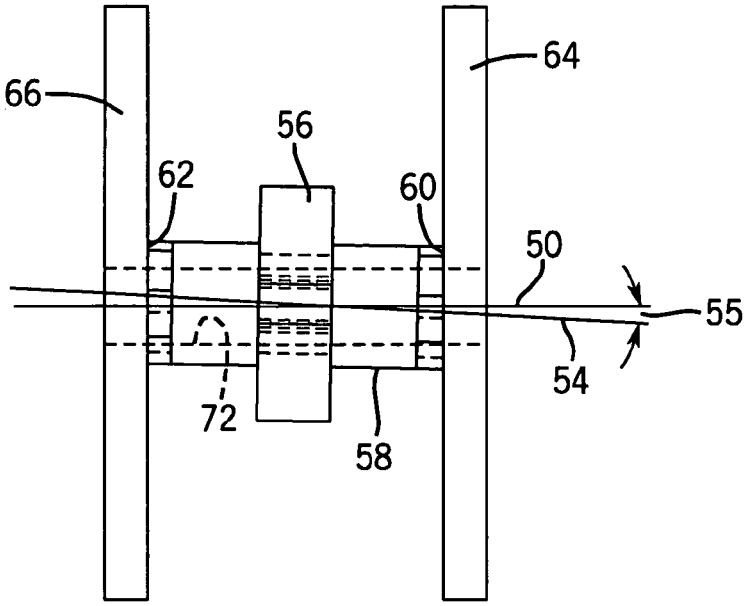
FIG. 4 is a top elevation view of a portion of the structure of FIG. 2.
Figure 5:
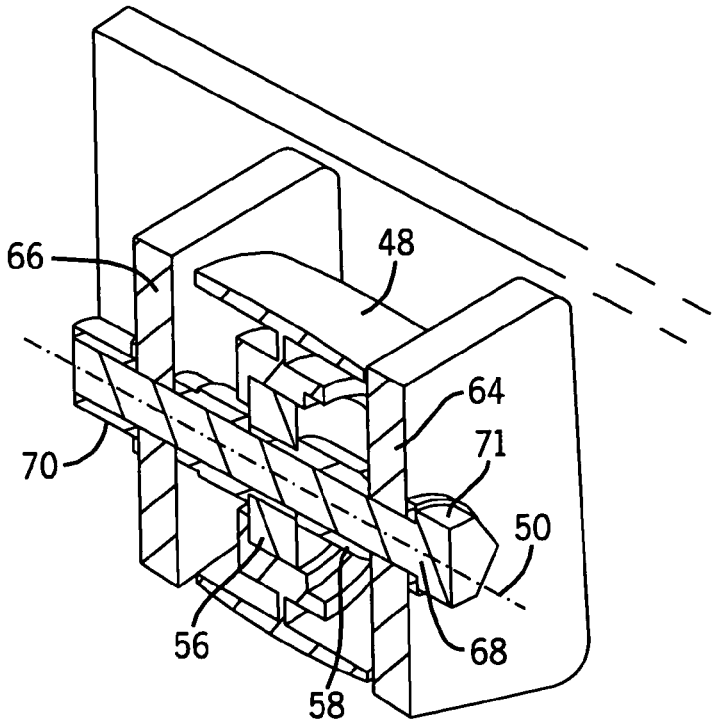
FIG. 5 is a partially cut-away view of a portion of the structure of FIG. 2.
Figure 6:
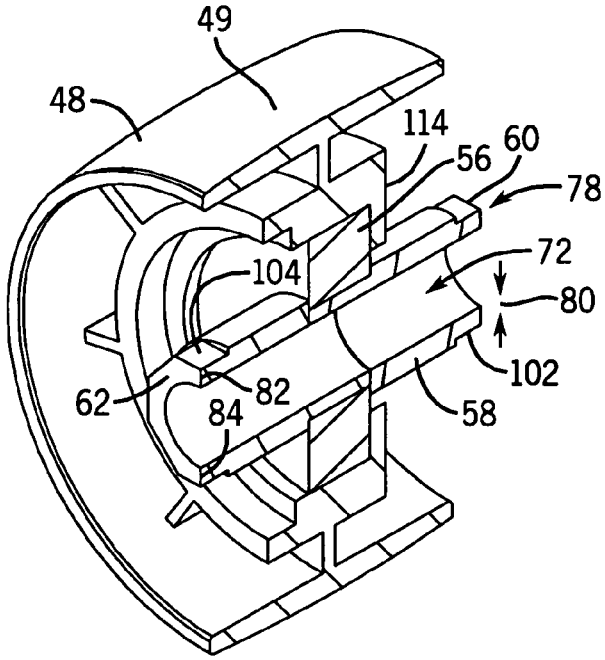
FIG. 6 is a cut-away isometric view of a tracking pulley and eccentric hub insert in accordance with the invention.

A tracking pulley 48 is between guide pulleys 24 and 26, and is mounted to frame 34 about a mounting axis 50. Belt 22 extends longitudinally and is moveable along a longitudinal direction 52 and engages and rotates tracking pulley 48 about a rotation axis 54, FIG. 4, which is noncoincident with and nonparallel to mounting axis 50, to be described. FIGS. 5 and 6 show tracking pulley 48 mounted on bearing 56 which in turn is mounted on hub insert 58. Tracking pulley 48 is preferably nylon. Bearing 56 is preferably an annular steel member having an outer circumference fixed to pulley 48, preferably by sonic welding, and having an inner circumference slidingly rotatable around and engaging hub insert 58 which is preferably of stainless steel.

Figure 7:
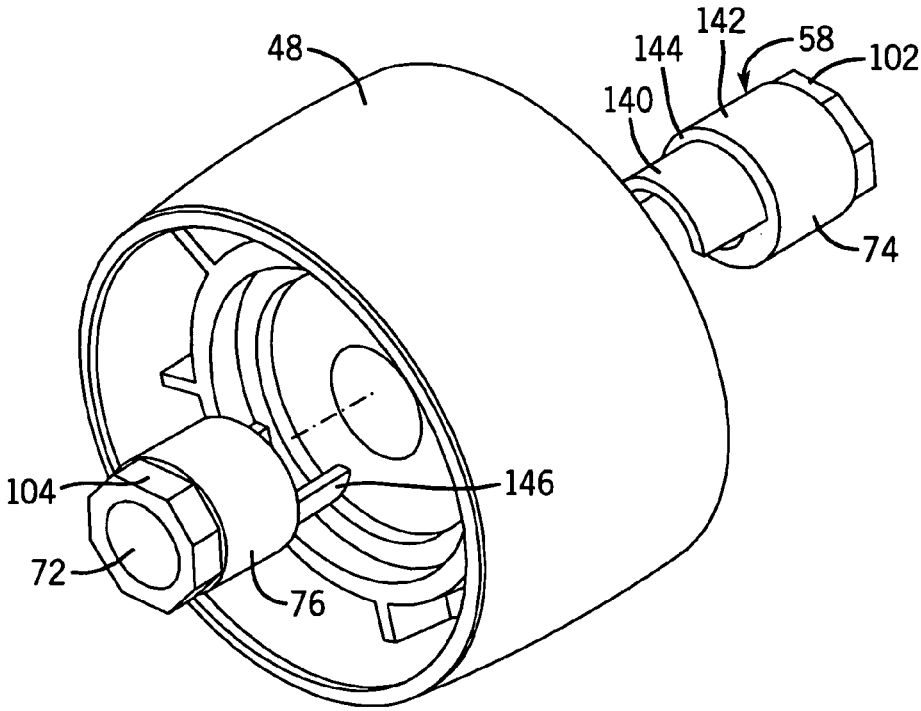
FIG. 7 is an exploded isometric elevation view of the structure of FIG. 6.
Figure 12:
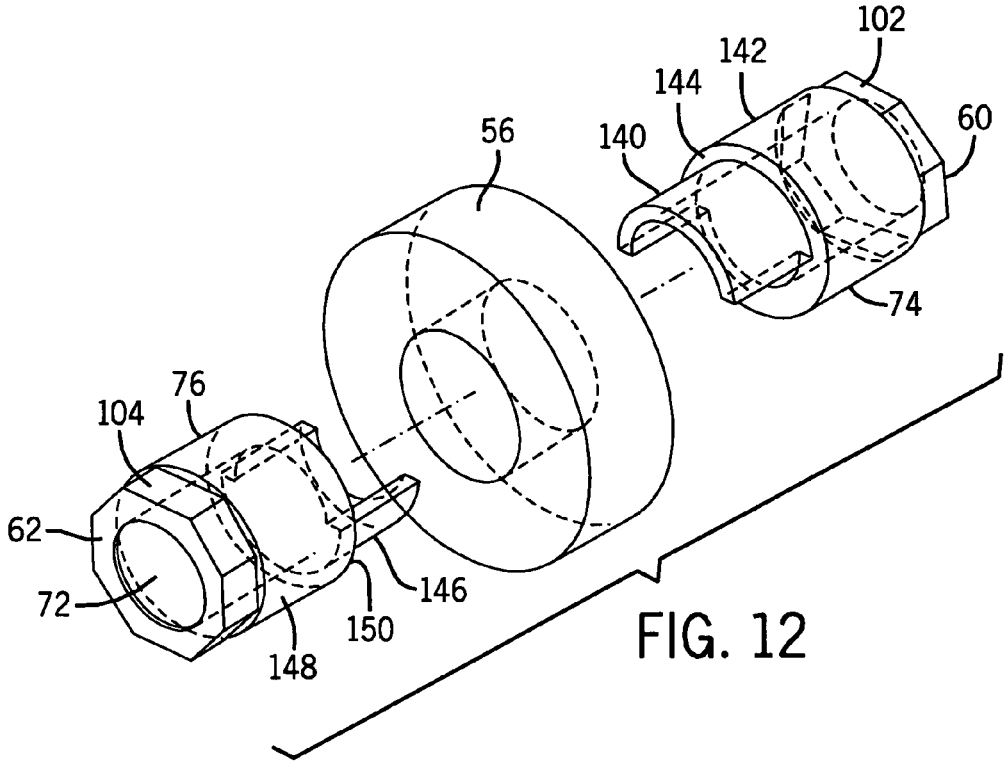
FIG. 12 is an exploded perspective view of a portion of the structure of FIG. 7.
Figure 13:
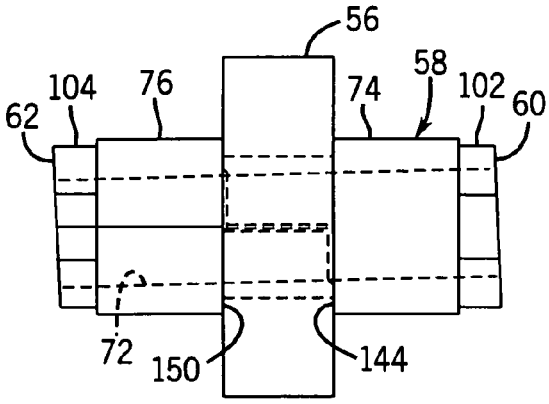
FIG. 13 is a side elevation view of the structure of FIG. 12 in assembled condition.
Figure 14:
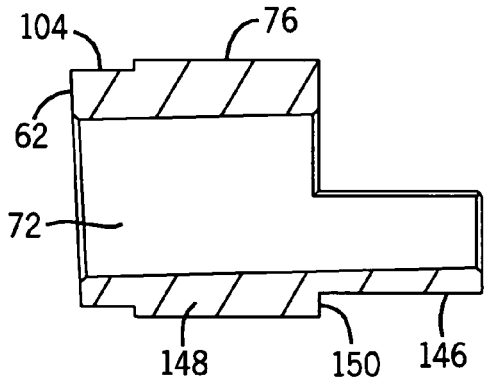
FIG. 14 is a side sectional view of one of the components of FIG. 12.

Hub insert 58 has distally opposite axial ends 60 and 62 engaged between sidewall members 64 and 66 of the frame, FIG. 5, and axially tightened thereagainst by bolt 68 and threaded nut 70, to prevent rotation of hub insert 58. Bolt 68 extends axially from head 71 to nut 70 and defines mounting axis 50 therealong. FIG. 4 shows hub insert 58 and bearing 56, with pulley 48 omitted. Hub insert 58 has an eccentric bore 72 therethrough, FIG. 6, mounting tracking pulley 48 to the frame along mounting axis 50. In the preferred embodiment, FIGS. 4–7, the hub insert is a two piece member having first and second distally opposite sections 74 and 76, FIG. 7, to be described, mating to define eccentric bore 72 therethrough. The eccentricity of bore 72 of two piece hub insert 58 is shown in FIG. 6 at thinner radial thickness 78 and thicker radial thickness 80 at axial end 60 of the hub insert, and at thicker radial thickness 82 and thinner radial thickness 84 at axial end 62.

In another embodiment, FIGS. 8, 9, the hub insert is a one piece member 86 having an eccentric bore 88 therethrough. The eccentricity of bore 88 of one piece hub insert 86 is shown in FIG. 8 at thinner radial thickness 90 and thicker radial thickness 92 at axial end 94 of hub insert 78, and at thicker radial thickness 96 and thinner radial thickness 98 at axial end 100.

Hub insert 58 is provided with keyed configurations 102 and 104, for example a hex shape, to enable rotation of hub insert 58 about axis 50 after loosening of nut 70 and bolt 68, to change the eccentricity of bore 72 relative to rotation axis 54 for changing the tracking angle of belt 22 on pulley 48, to be further described. Likewise, one piece hub insert 78 has a keyed configuration such as flats 106, 108, FIGS. 9, 10, for changing relative eccentricity of bore 88 after loosening of bolt 68 and nut 70. After the noted loosening of bolt 68 and nut 70, the hub insert may be rotated by a wrench 110, FIG. 3 or the like.

In FIG. 10, a nylon annular end cap 112 is sonically welded to pulley 48 to axially trap and hold bearing 56 within the pulley around the hub insert, and as held at the other axial end by a shoulder such as 114 on the pulley. FIG. 11 shows the assembled condition of the pulley mounting arrangement on one piece insert 78. End cap 112 may also be used in conjunction with the two piece hub insert mounting arrangement noted above.

Guide pulley 24, FIG. 3, is mounted to the frame by bolt 120 for rotation about rotation axis 122. Guide pulley 26 is mounted to the frame by bolt 124 for rotation about rotation axis 126. Longitudinally extending belt 22 is moveable along the noted longitudinal direction 52 between guide pulleys 24 and 26. As noted above, tracking pulley 48 is between guide pulleys 24 and 26 and is engaged and rotated by belt 22 moving along the noted longitudinal direction 52. Tracking pulley 48 is mounted to the frame by bolt 68 for rotation about rotation axis 54. In the disclosed embodiment, rotation axes 122 and 126 are parallel to each other and define a plane therebetween, and rotation axis 54 is nonparallel to each of rotation axes 122 and 126 and to the noted plane therebetween and intersects such plane at a given angle, preferably in the range of 2 to 5°, to be described.

Belt 22 engages guide pulley 24 along a first engagement line 128 transverse to the noted longitudinal direction 52. Belt 22 engages guide pulley 26 along an engagement line 130 transverse to the noted longitudinal direction 52. Belt 22 engages tracking pulley 48 along an engagement line 132 transverse to the noted longitudinal direction 52. Hub insert 58 mounts tracking pulley 48 to the frame to rotate about rotation axis 54 such that engagement line 132 is nonparallel to each of engagement lines 128 and 130 and nonparallel to mounting axis 50. Engagement lines 128 and 130 are parallel to each other and are coplanar and define a plane therebetween, and engagement line 132 is nonparallel to such plane and intersects such plane at a given angle, preferably 2 to 5°. Hub insert 58, having eccentric bore 72 therethrough, mounts tracking pulley 48 to the frame along mounting axis 50 nonparallel to rotation axis 54 and nonparallel to engagement line 132. Hub insert 58 extends axially along rotation axis 54. Eccentric bore 72 extends axially along mounting axis 50. Rotation axis 54 and mounting axis 50 are nonparallel and intersect at a given angle 55, FIG. 4, preferably in the range of 2 to 5°. Engagement line 132 and mounting axis 50 define a tracking angle therebetween. Adjustment key 102 and/or 104 is provided for rotating hub insert 58 about mounting axis 50 to adjustably change such tracking angle upon loosening of bolt 68 and nut 70. Pulley 48 may be crowned along belt-engaging surface 49 if desired for further alignment and tracking.

Hub insert 58 is provided by first and second distally opposite sections 74 and 76 axially slidable into mating keyed engagement with each other for receiving tracking pulley 48 therearound at bearing 56, FIGS. 4–7, 12–14. Section 74 has a leading axial segment 140, FIGS. 7, 12, joined to a trailing axial segment 142 by a radial step 144. Section 76 has a leading axial segment 146 joined to a trailing axial segment 148 by a radial step 150. Leading axial segment 140 axially slides along leading axial segment 146 to an axially inserted assembled condition, FIGS. 4, 6, 13, with radial steps 144, 150 axially separated for receiving bearing 56 of pulley 48 journaled therearound and axially trapped between radial steps 144 and 150. Annular bearing 56 has the noted outer circumference fixed to tracking pulley 48, and has the noted inner circumference rotatable around hub insert 58 at the noted first and second leading axial segments 140 and 146, with bearing 56 at its inner circumference being axially trapped between the noted first and second radial steps 146 and 150. The first and second leading axial segments 140 and 146 in the noted axially assembled condition define an inner bearing race for the tracking pulley at bearing 56, with leading axial segment 140 defining a first arcuate portion of such race, and leading axial segment 146 defining a second arcuate portion of such race. In preferred form, each arcuate portion is semi-circular. Further in preferred form, the disclosed construction enables sections 74 and 76 to be identical, for desirable economy of manufacture. The noted axial ends 60 and 62 of the hub insert have the noted keyed configuration for gripping the hub insert and rotating the hub insert, as noted, upon loosening of bolt 68 and nut 70, to change the eccentricity of bore 72 relative to rotation axis 54 and relative to engagement line 132 for changing the noted tracking angle of belt 22 along tracking pulley 48.

It is recognized that various equivalents, alternatives and modifications are possible within the scope of the appended claims.

What is claimed is:

1. In an exercise apparatus having a longitudinally extending belt movable along a longitudinal direction and engaging and rotating a tracking pulley mounted to a frame to rotate about a rotation axis, said belt engaging said tracking pulley along an engagement line transverse to said longitudinal direction, a hub insert having an eccentric bore therethrough mounting said tracking pulley to said frame along a mounting axis non-parallel to at least one of said rotation axis and said engagement line.

2. The hub insert according to claim 1 wherein said hub insert extends axially along said rotation axis, said eccentric bore extends axially along said mounting axis, and said rotation axis and said mounting axis are non-parallel and intersect at a given angle.

3. The hub insert according to claim 1 wherein said engagement line and said mounting axis define a tracking angle therebetween, said hub insert extends between axial ends, and at least one of said axial ends has an adjustment key for rotating said hub insert about said mounting axis to adjustably change said tracking angle.

4. The hub insert according to claim 1 comprising first and second distally opposite sections axially slidable into mating keyed engagement with each other for receiving said pulley therearound, said first section having a first leading axial segment joined to a first trailing axial segment by a first radial step, said second section having a second leading axial segment joined to a second trailing axial segment by a second radial step, said first leading axial segment axially sliding along said second leading axial segment to an axially inserted assembled condition with said first and second radial steps axially separated for receiving said pulley journaled therearound and axially trapped between said first and second radial steps.

5. The hub insert according to claim 4 comprising an annular bearing having an outer circumference fixed to said tracking pulley, and having an inner circumference rotatable around said hub insert at said first and second leading axial segments, said bearing at said inner circumference being axially trapped between said first and second radial steps.

6. The hub insert according to claim 4 wherein said first and second leading axial segments in axially assembled condition define an inner bearing race for said tracking pulley, said first leading axial segment defining a first arcuate portion of said race, said second leading axial segment defining a second arcuate portion of said race.

7. The hub insert according to claim 4 wherein said first and second sections are identical.

8. The hub insert according to claim 4 comprising distally opposite axial ends, and wherein at least one of said ends has a keyed configuration for gripping said hub insert and rotating said hub insert to change the eccentricity of said bore relative to said rotation axis and relative to said engagement line for changing a tracking angle of said belt along said tracking pulley.

* * * * *